US007307208B2

(12) United States Patent
Sasaki

(10) Patent No.: US 7,307,208 B2
(45) Date of Patent: Dec. 11, 2007

(54) HIGH-FIDELITY AUTOMATIC PLAYER MUSICAL INSTRUMENT, AUTOMATIC PLAYER USED THEREIN AND METHOD EMPLOYED THEREIN

(75) Inventor: Tomoyo Sasaki, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 296 days.

(21) Appl. No.: 11/218,116

(22) Filed: Sep. 1, 2005

(65) Prior Publication Data

US 2006/0048624 A1 Mar. 9, 2006

(30) Foreign Application Priority Data

Sep. 7, 2004 (JP) ..... 2004-259867

(51) Int. Cl.
*G10H 1/32* (2006.01)

(52) U.S. Cl. ..... 84/719; 84/723; 84/743; 84/744

(58) Field of Classification Search ..... None
See application file for complete search history.

(56) References Cited

U.S. PATENT DOCUMENTS 5,627,333 A * 5/1997 Stahnke et al. ..... 84/462
5,691,489 A 11/1997 Fujiwara et al.
6,271,447 B1 * 8/2001 Fujiwara et al. ..... 84/21
6,297,437 B1 * 10/2001 Ura et al. ..... 84/423 R
6,359,207 B1 * 3/2002 Oba et al. ..... 84/658
6,683,242 B2 * 1/2004 Inoue et al. ..... 84/719
2002/0121183 A1 * 9/2002 Inoue et al. ..... 84/719
2004/0025674 A1 * 2/2004 Muramatsu et al. ..... 84/719

FOREIGN PATENT DOCUMENTS

JP 9-81125 3/1997

* cited by examiner

*Primary Examiner*—Marlon Fletcher
(74) *Attorney, Agent, or Firm*—Harness, Dickey & Pierce, PLC

(57) ABSTRACT

An automatic player piano includes key sensors, solenoid-operated key actuators and a controller, which form a servo-control loop, and the key motion is reproduced under the control of the servo-control loop; the servo-control loop adjusts the driving pulse signal to a target duty ratio or mean current so as to force the black and white keys to travel on reference key trajectories; the controller categorizes the key motion in half-stroke or full-stroke, and determines the target duty ratio on the basis of a deviation between the target key position and the actual key position, a deviation between the target key velocity and the actual key velocity and the sort of key motion so as to make the key motion stable.

18 Claims, 7 Drawing Sheets

| | rv≦200mm/s<br>rx=0 to 5mm | rv≦200mm/s<br>rx=5 to 10mm | rv>200mm/s<br>rx=0 to 4mm | rv>200mm/s<br>rx=4 to 10mm |
|---|---|---|---|---|
| Kx | 0. 1 | 0. 1 | 0. 6 | 0. 15 |
| Kv | 0. 2 | 0. 4 | 0. 3 | 0. 4 |
| ADDEND u | 15% | 9+4×rv/100% | 9+2×(rv−100)/100% | 9+2×(rv−100)/100% |

Fig. 4

| | rv ≦100mm/s<br>rx=0 to 4mm | rv≦100mm/s<br>rx=4 to 10mm | rv>100mm/s<br>rx=0 to 4mm | rv>100mm/s<br>rx=4 to 10mm |
|---|---|---|---|---|
| Kx | 0. 6 | 0. 2 | 0. 6 | 0. 2 |
| Kv | 0. 3 | 0. 3 | 0. 3 | 0. 3 |
| $ADDEND_u$ | 9% | 9% | 9+2×(rv−100)/100% | 9+2×(rv−100)/100% |

Fig. 5

HIGH-FIDELITY AUTOMATIC PLAYER MUSICAL INSTRUMENT, AUTOMATIC PLAYER USED THEREIN AND METHOD EMPLOYED THEREIN

FIELD OF THE INVENTION

This invention relates to an automatic player musical instrument for automatically playing pieces of music, and, more particularly, to an automatic player musical instrument for automatically playing pieces of music on the basis of music data codes, an automatic player forming a part of the automatic player musical instrument and a method for controlling the automatic player musical instrument.

DESCRIPTION OF THE RELATED ART

An automatic player piano is a typical example of the automatic player musical instrument. The automatic player piano is fabricated from an acoustic piano and an automatic playing system, and the automatic playing system selectively gives rise to the key motion on the basis of music data codes such as those defined in the MIDI (Musical Instrument Digital Interface) protocols. The black and white keys give rise to the rotation of the hammers through the action units during the key motion, and the hammers are brought into collision with the strings at the end of the rotation. Then, the strings start to vibrate, and the vibrations give rise to the piano tones.

The loudness of piano tones is proportional to the hammer velocity immediately before the strikes at the strings, and the hammer velocity is proportional to the key velocity at the certain points on the key trajectories. For this reason, it is possible to adjust the piano tones to target loudness by controlling the black and white keys. The certain points are hereinafter referred to as "reference key points", and the key velocity at the reference key points is referred to as "reference key velocity". The key trajectories previously determined on the basis of the music data codes are hereinafter referred to as "reference key trajectories". The black and white keys pass the reference key points at target values of the reference key velocity in so far as the black and white keys travel on the reference key trajectories.

The solenoid-operated key actuators and suitable sensors form a servo-control loop together with a data processing unit. Since the key velocity is varied with the magnitude of the driving signals supplied to the solenoid-operated key actuators, the data processing unit periodically checks pieces of key data representative of the key motion to see whether or not the black and white keys travel on the reference key trajectories. While the black and white keys are traveling on the reference key trajectories, the data processing unit keeps the driving signal at the target values of the magnitude. However, if the black and white keys are deviated from the reference key trajectories, the data processing unit increases or decreases the target values of magnitude so as to force the black and white keys to travel on the reference key trajectories. Thus, the black and white keys are under the control through the servo-control loop during the automatic playing.

The prior art servo-control techniques are disclosed in Japanese Patent Publication Nos. 2923541 and 2737669 and Japanese Patent Application laid-open No. Hei 10-228276. In the prior art servo-control techniques disclosed in Japanese Patent Publication Nos. 2923541 and 2737669, the key motion is controlled through comparison of the target key velocity and target keystroke with the actual key velocity and actual keystroke reported from the sensors. The offset value and gains are arbitrarily given to the data processing unit from the outside in the prior art servo-control technique disclosed in Japanese Patent Application laid-open No. Hei 10-228276, and the offset value and gains are expected to remove the individuality of product from the prior art automatic player piano.

Although a simple music passage is well reproduced through the prior art automatic player piano, the audience feels a complicated music passage on the playback sometimes curious. Thus, the problem inherent in the prior art automatic player piano is the low fidelity.

SUMMARY OF THE INVENTION

It is therefore an important object of the present invention to provide an automatic player musical instrument, the fidelity of which is enhanced.

It is also an important object of the present invention to provide an automatic player, which is suitable for the automatic player musical instrument.

It is another important object of the present invention to provide a method for automatically producing a piece of music with high fidelity.

The present inventor contemplated the problem inherent in the prior art automatic player piano, and noticed that the prior art automatic player piano failed to produce the piano tones through some sorts of fingering such as the half stroke. In the half stroke, the black and white keys were released on the way to the end position, and were depressed on the way to the rest position, again. The present inventor found that the black and white keys did not follow up the plunger motion, and the tones were produced at different loudness. When the automatic player produced the tones at small loudness, this phenomenon was serious. In detail, when the data processing unit was requested to produce a tone, the data processing unit specified the black or white key to be pushed with the solenoid-operated key actuator, a target value of reference key velocity and a time to start to push the black or white key. In order to determine the time to start to push the black or white key, the data processing unit reckoned backward from the time to produce the tone in consideration of the key velocity. If the key velocity was high, i.e., the target loudness was large, the time to start to push the key was close to the time to produce the tone. However, when the key velocity was low, the lapse of time was to be set long. Although the tone was to be repeated at short intervals, the automatic player required a long lapse of time between the time to start to push the key and the time to produce the tone for the repetition at small loudness. Thus, the automatic player was expected to make the conflicting conditions compromise with one another. When the automatic player failed in the compromise, the plunger beats the black/white key, or strongly pushed it. This resulted in the tones at different loudness, and the audience felt the performance curious. The present inventor concluded that the conditions for the servo-control were to be different between the half stroke and the ordinary key motion.

To accomplish the object, the present invention proposes to vary the magnitude of a driving signal depending upon the sort of motion.

In accordance with one aspect of the present invention, there is provided an automatic player musical instrument for producing tones comprising an acoustic musical instrument including plural manipulators selectively moved for specifying the pitch of the tones and a tone generator connected to the plural manipulators and responsive to motion of the plural manipulators for producing the tones at the specified pitch and an automatic player including plural sensors for producing detecting signals representative of a physical quantity expressing the motion, plural actuators selectively energized with a driving signal so as to give rise to the motion of the plural manipulators and a controller connected to the plural sensors and the plural actuators for forming a servo-control loop and forcing the plural manipulators to travel on reference trajectories with the driving signal, the magnitude of which contains a loop gain component representative of response characteristics of the servo-control loop and a fundamental component representative of a constant load to be exerted on the plural manipulators, the controller categorizes the motion in a first sort of motion in which the plural manipulators change the direction of motion through a reversal longer than a critical time period or a second sort of motion in which the plural manipulators change the direction of motion through the reversal equal to or shorter than the critical time period, and the controller enlarges the fundamental component around the reversal in the second sort of motion so as to keep the motion stable.

In accordance with another aspect of the present invention, there is provided an automatic player for a musical instrument having plural manipulators and a tone generator comprising plural sensors for producing detecting signals representative of a physical quantity expressing motion of the plural manipulators, plural actuators selectively energized with a driving signal so as to give rise to the motion of the plural manipulators and a controller connected to the plural sensors and the plural actuators for forming a servo-control loop and forcing the plural manipulators to travel on reference trajectories with the driving signal, the magnitude of which contains a loop gain component representative of response characteristics of the servo-control loop and a fundamental component representative of a constant load to be exerted on the plural manipulators, the controller categorizes the motion in a first sort of motion in which the plural manipulators change the direction of motion through a reversal longer than a critical time period or a second sort of motion in which the plural manipulators change the direction of motion through the reversal equal to or shorter than the critical time period, and the controller enlarges the fundamental component around the reversal in the second sort of motion so as to keep the motion stable.

In accordance with yet another aspect of the present invention, there is provided a method for controlling manipulators of a musical instrument through a servo-control loop comprising the steps of a) comparing a target value of physical quantity on a reference trajectory representative of motion of a manipulator to be realized with an actual value of the physical quantity on an actual trajectory along which the manipulator travels so that a deviation of the actual trajectory from the reference trajectory is determined through the comparison, b) adjusting a driving signal to a magnitude containing a first component determined on the basis of a loop gain representative of response characteristics of the servo-control loop for reducing the deviation and a second component having a relatively small value when the motion of the manipulator is categorized in a first sort of motion in which the manipulator changes the direction of the motion through a reversal longer than a critical time period, c) adjusting the driving signal to another magnitude containing the first component and the second component having a relatively large value when the motion of the manipulator is categorized in a second sort of motion in which the manipulator changes the direction of motion through the reversal equal to or shorter than the critical time period without executing the step c), d) supplying the driving signal to an actuator associated with the manipulator and forming a part of the servo-control loop so that the manipulator is further moved on the actual trajectory, and e) repeating the steps a) to d) until the manipulator reaches the end of the reference trajectory.

BRIEF DESCRIPTION OF THE DRAWINGS

The features and advantages of the automatic player musical instrument, automatic player and method will be more clearly understood from the following description taken in conjunction with the accompanying drawings, in which FIG. 4 is a view showing gain and addend tables to be accessed for repetition, FIG. 5 is a view showing gain and addend tables to be accessed for standard fingering.

DESCRIPTION OF THE PREFERRED EMBODIMENTS

Figure 1:
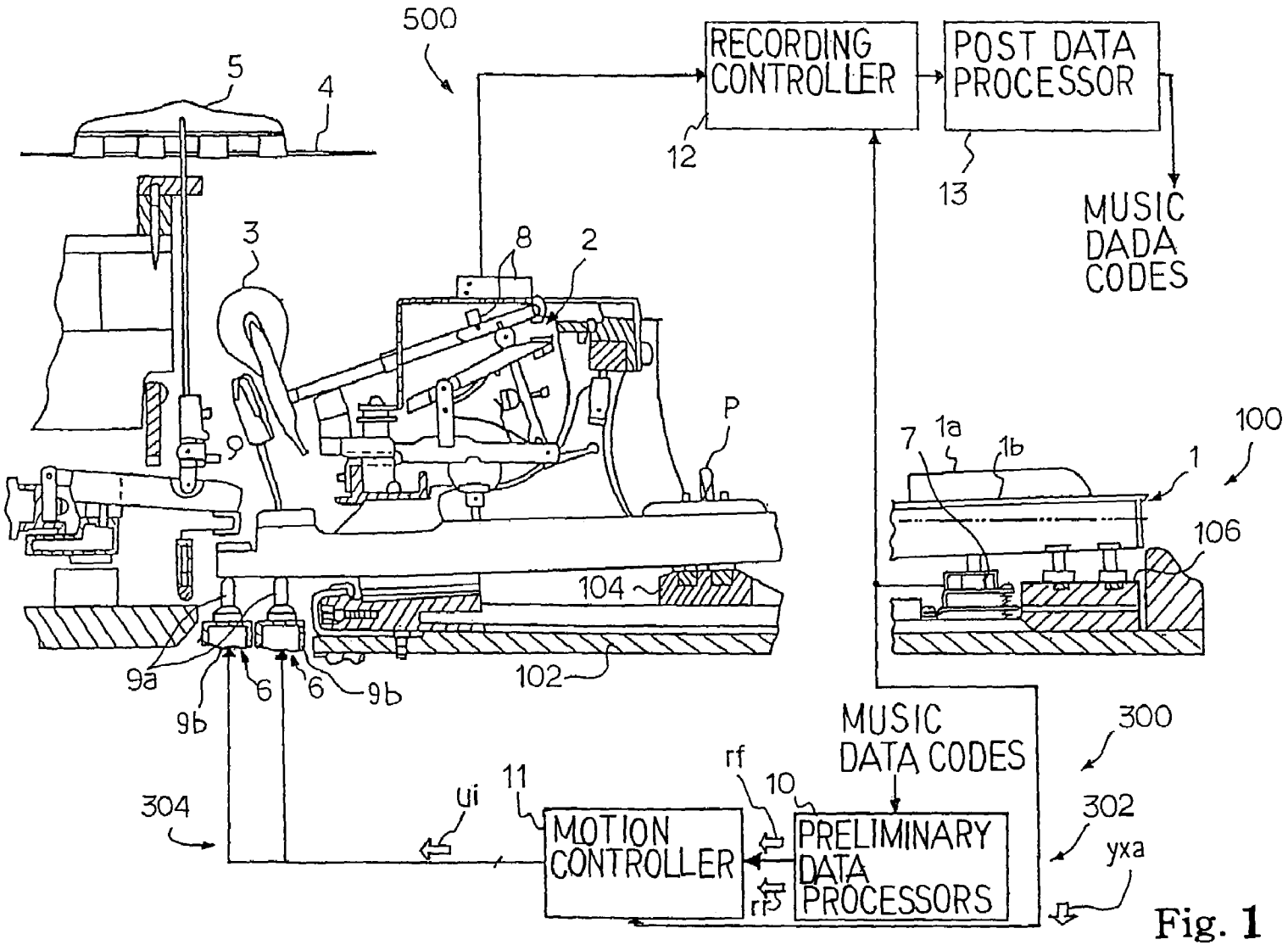
FIG. 1 is a side view showing the structure of an automatic player piano according to the present invention.

An automatic player musical instrument embodying the present invention largely comprises an acoustic musical instrument and an automatic player. Although any sort of musical instrument serves as the acoustic musical instrument, description is hereinafter made on the assumption that an acoustic piano serve as the acoustic musical instrument for better understanding.

Since a player depresses and releases black and white keys for specifying the pitch of tones to be produced, the black and white keys serve as "manipulators". The motion of the black and white keys gives rise to free rotation of the hammers through action units, and strings are struck with the hammers at the end of the free rotation for producing the tones. For this reason, the action units, hammers and strings as a whole constitute a "tone generator".

The automatic player includes actuators, sensors and a controller, and the actuators, sensors and controller form a servo-control loop. In this instance, the actuators give rise to the key motion, and the sensors monitor the black and white keys, respectively. However, the actuators may directly actuate the action units, and the sensors may monitor the movable parts of the actuators.

The controller selectively energizes the actuators so as to give rise to the key motion. On the other hand, the sensors produce detecting signals representative of a physical quantity, which expresses the key motion of the associated black and white keys. While the automatic player is reenacting a performance expressed by a set of music data codes, the controller analyzes the music data code for determining a reference key trajectory.

The reference key trajectory is a target key position varied with time. If the black and white keys travel on the reference key trajectories, the hammers are brought into collision with the associated strings at target final hammer velocity, and the tones are produced at target loudness. For this reason, the controller makes the actuators force the black and white keys to travel on the reference key trajectories with the driving signals. If the controller finds a black/white key to be deviated from the reference key trajectory, the controller varies the magnitude of the driving signal so as to make the actual key trajectory consistent with the reference key trajectory.

If a player depressed all the black and white keys from rest positions to end positions in the original performance, the key motion was categorized in full-stroke, and the full-stroke key motion would be well reproduced through the prior art controlling technologies. However, the player usually mixes half-stroke with the full-stroke in the original performance. A typical example of the half-stroke is the key motion in which the player depresses the black/white key on the way from the end position to the rest position. The turning point between the upward motion and the downward motion is referred to as "reversal". When the player repeatedly depresses a black/white key, i.e., repetition, the key motion is categorized in the half-stroke. The repetition is not an only example of the half-stroke. The half-stroke is troublesome in the automatic playing as described in conjunction with the prior art.

The criterion between the full-stroke and the half-stroke is the transit time in the reversal. The critical time period for the transition is different among the models of piano. The transit time period of zero is proper to a certain model of piano, and 100 milliseconds for another model of piano. However, the critical time period of 100 milliseconds is too long for yet another model and too short to still another model. For this reason, the manufacturer determines the proper critical time period through experiments.

The magnitude of the driving signal is broken down into a loop gain component and a fundamental component. The loop gain component expresses response characteristics of the servo-control loop. If the loop gain component is enlarged, the servo-control loop tries rapidly to minimize the deviation between the reference key trajectory and the actual key trajectory, and the key motion becomes unstable. On the other hand, the fundamental component expresses a constant load to be exerted on the black/white keys. If the fundamental component is enlarged, the black and white keys tries to keep the tendency of the key motion, and the key motion becomes stable.

The controller according to the present invention categorizes the key motion to be realized in the first sort of key motion, i.e., the full-stroke or in the second sort of key motion, i.e., the half-stroke, and adjusts the loop gain component and fundamental component to an optimum ratio depending upon the sort of key motion. The key motion is assumed to be categorized in the half-stroke. The controller increases the fundamental components around the reversal. Then, the key motion becomes stable, and the tones are produced at target loudness. This is the prominent feature of the present invention. When the black/white key exhibits the half-stroke at a relatively low speed, the enlargement of fundamental component is effective against the problems inherent in the prior art. The criterion between the high speed and the low speed is dependent on the model of piano. A certain model of piano has the boundary between the high speed and the low speed at 200 millimeters per second. However, the boundary is too fast for another model, and is too slow for yet another model. The manufacture determines the boundary through experiments.

If the loop gain component is reduced around the reversal on the condition that the fundamental component is enlarged, the key motion becomes more stable, and is desirable. However, while the black and white keys are traveling in a region spaced from the reversal, strong servo-control is required for the black and white keys. For this reason, the loop gain component is enlarged. The boundary between the region and another region around the reversal is different among models of piano. A certain model of piano has the full keystroke of the order of 10 millimeters, and the boundary between the two regions is found at the middle point between the rest position and the end position. However, the boundary between the two regions is varied depending upon the models of piano. The manufacturer also determines the boundary through the experiments.

As will be understood from the foregoing description, the controller selectively categorizes the key motion to be realized into the two sorts of key motion, and optimizes the ratio between the loop gain component and the fundamental component depending upon the sort of key motion. As a result, the key motion around the reversal becomes stable, and the acoustic piano produces the tones at the target loudness without undesirable double strike and missing tone.

In the following description, term "front" is indicative of a position closer to a player, who is sitting on a stool for fingering, than a position modified with term "rear". A line drawn between a front position and a corresponding rear position extends the "fore-and-aft" direction, and the lateral direction crosses the fore-and-aft direction at right angle.

First Embodiment

Referring to FIG. 1 of the drawings, an automatic player piano embodying the present invention largely comprises an acoustic piano 100 and an electric system, which serves as an automatic playing system 300 and a recording system 500. The automatic playing system 300 and recording system 500 are installed in the acoustic piano 100, and are selectively activated depending upon the mode of operation. While a player is fingering a piece of music on the acoustic piano 100 without any instruction for recording and playback, the acoustic piano 100 behaves as similar to a standard acoustic piano, and generates the piano tones at the pitch specified through the fingering.

When the player wishes to record his or her performance on the acoustic piano 100, the player gives the instruction for the recording to the electric system, and the recording system 500 gets ready to record the performance. Then, the recording system 500 is activated. While the player is fingering on the acoustic piano 100, the recording system 500 produces music data codes representative of the performance on the acoustic piano 100. Thus, the performance is memorized in a set of music data codes.

A user is assumed to wish to reproduce the performance. The user instructs the electric system to reproduce the acoustic tones. Then, the automatic playing system 300 gets ready for the playback. The automatic playing system 300 fingers the piece of music on the acoustic piano 100, and reenacts the performance without the fingering of the human player.

The acoustic piano 100, automatic playing system 300 and recording system 500 are hereinafter described in detail.

Acoustic Piano

In this instance, the acoustic piano 100 is a grand piano. The acoustic piano 100 includes a keyboard 1, action units 2, hammers 3, strings 4 and dampers 5. A key bed 102 forms a part of a piano cabinet, and the keyboard 1 is mounted on the key bed 102. The keyboard 1 is linked with the action units 2 and dampers 5, and a pianist selectively actuates the action units 2 and dampers 5 through the keyboard 1. The dampers 5, which have been selectively actuated through the keyboard 1, are spaced from the associated strings 4 so that the strings 4 get ready to vibrate. On the other hand, the action units 2, which have been selectively actuated through the keyboard 1, give rise to free rotation of the associated hammers 3, and the hammers 3 strike the associated strings 4 at the end of the free rotation. Then, the strings 4 vibrate, and the acoustic tones are produced through the vibrations of the strings 4. Thus, the keyboard 1, action units 2, dampers 5, hammers 3 and strings 4 behave as similar to those of a standard acoustic piano.

The keyboard 1 includes plural black keys 1*a*, plural white keys 1*b* and a balance rail 104. In this instance, eighty-eight keys 1*a*/1*b* are incorporated in the keyboard 1. The black keys 1*a* and white keys 1*b* are laid on the well-known pattern, and are movably supported on the balance rail 104 by means of balance key pins P. While any force is not exerted on the black/white keys 1*a*/1*b*, the hammers 3 and action units 2 exert the self-weight on the rear portions of the black/white keys 1*a*/1*b*, and the front portions of the black/white keys 1*a*/1*b* are spaced from the front rail 106 as drawn by real lines. The key position indicated by the rear lines is "rest position", and the keystroke is zero.

When a pianist depresses the black/white keys 1*a*/1*b*, the front portions are sunk against the self-weight of the action units/hammers 2/3, and reach "end positions" indicated by dots-and-dash lines. The end positions are spaced from the rest positions along the key trajectories by 10 millimeters. In other words, the keystroke from the rest positions to the end positions is 10 millimeters.

A user is assumed to depress the front portions of the black and white keys 1*a*/1*b*. The front portions are sunk toward the front rail 106, and the rear portions are raised. The key motion gives rise to the activation of the associated action units 2, and further causes the strings 4 to get ready for the vibrations as described hereinbefore. The activated action units 2 drive the associated hammers 3 for the free rotation through the escape. The hammers 3 strike the associated strings 4 at the end of the free rotation for producing the acoustic tones. The hammers 3 rebound on the strings 4, and are dropped onto the associated key action units 2, again.

When the user releases the black and white keys 1*a*/1*b*, the self-weight of the action units/hammers 2/3 gives rise to the rotation of the black and white keys 1*a*/1*b* in the counter direction so that the black and white keys 1*a*/1*b* return to the rest positions. The dampers 5 are brought into contact with the associated strings 4 so that the acoustic tones are decayed. The key action units 2 return to the rest positions, again. Thus, the human pianist can give rise to the angular key motion about the balance rail 104 like a seesaw.

Automatic Playing System

Description is hereinafter made on the automatic playing system 300 and recording system 500 with reference to FIG. 2 concurrently with FIG. 1. The automatic playing system 300 includes an array of key actuators 6, key sensors 7, a memory device 23, a manipulating panel (not shown) and a controller 302. On the other hand, the recording system 500 includes hammer sensors 8, the key sensors 7, memory device 23, controller 302 and manipulating panel (not shown). Thus, the system components 7, 23 controller 302 and manipulating panel (not shown) are shared between the automatic playing system 300 and the recording system 500.

The function of the controller 302, which forms a part of the automatic playing system 300, is broken down into a preliminary data processor 10 and a motion controller 11. A set of music data codes representative of the performance to be reenacted is loaded to the preliminary data processor 10. The set of music data is, by way of example, memorized in the memory device 23. The key sensors 7 supplies key position signals representative of actual key positions to the motion controller 11. The key position signals serve as feedback signals yxa. The preliminary data processor 10 sequentially analyzes the music data codes, and determines the piano tones to be reproduced and timing at which the piano tones are reproduced. When the time to start to push the black/white key 1*a*/1*b* comes, the preliminary data processor 10 determines reference trajectories for the black/white keys 1*a*/1*b*, and supplies a control data signal rf representative of the reference key trajectories to the motion controller 11. The reference key trajectory is a series of target values of the key position varied with time. Thus, the control signal rf representative of the target value varied with time is supplied from the preliminary data processor 10 to the motion controller 11. The black/white keys 1*a*/1*b* passes a reference key point at a target value of reference key velocity, and causes the associated hammer 3 to obtain the final hammer velocity, which is proportional to the loudness of tone, on the condition that the associated black/white key 1*a*/1*b* travels on the reference key trajectory.

The preliminary data processor 10 further analyzes the series of target values of target key position, i.e., the reference key trajectory to see whether or not the key motion is categorized in full-stroke or half-stroke. If the black/white key is immediately depressed at the rest position or a certain position on the way to the rest position, the reference key trajectory is continued from the previous reference key trajectory without a stoppage at the rest position or certain position, i.e., the reference key trajectory crosses the previous reference key trajectory, and the preliminary data processor 10 judges the key motion to be categorized in the half-stroke. On the other hand, when the reference key trajectory has the starting point of the downward path spaced from the end point of the upward path of the previous reference key trajectory, the preliminary data processor 10 judges the key motion to be categorized in the full-stroke. Thus, the preliminary data processor 10 judges the sort of fingering on the basis of the reference key trajectories for each black/white key 1*a*/1*b* to be moved. The method for judging the key motion is disclosed in Japanese Patent Application laid-open No. Hei 9-81125. In this instance, the method disclosed in the Japanese Patent Application laid-open is employed in the automatic player 302 so that the preliminary data processor 10 searches the series of values on the target key positions for the reversal of the key motion without stoppage at the rest position.

The method disclosed in the Japanese Patent Application laid-open includes the following steps. The reference trajectory toward the end position is referred to as "reference forward trajectory", and the reference trajectory in the opposite direction is referred to as "reference backward trajectory". First, the controller takes the initial velocity on the reference forward trajectory, reference point, rest position and time at which the key passes the reference point, and estimates the starting time at which the key starts the motion on the reference forward trajectory, and further estimates the an arrival time t3 at the end position on the basis of the starting time and key velocity. Subsequently, the controller takes the reference point on the reference backward trajectory, time at which the key passes the reference point and initial key velocity on the reference backward trajectory, and estimates the starting time t0N at which the key starts the motion on the reference backward trajectory. If the starting time t0N is earlier than the arrival time t3 is, the controller judges the key motion to be the half stroke.

The criterion between the half-stroke and the full-stroke is an interval between the present key motion and the previous key motion. If the interval is equal to or less than a critical time period, the key motion is categorized in the half-stroke. On the other hand, if the black/white key 1*a*/1*b* stops for a time period longer than the critical time period, the key motion is categorized in the full-stroke. The critical time period is variable depending upon the piano model. For this reason, the manufacturer determines the critical time period through experiments. In this instance, the critical time period is of the order of zero.

When the preliminary data processor 10 judges the key motion to be categorized in the half-stroke, the preliminary data processor 10 acknowledges the repetition, and raises a flag rr representative of the judgment, i.e., sets the flag rr to "1". On the other hand, when the preliminary data processor 10 judges the key motion to be categorized in the full-stroke, the preliminary data processor 10 acknowledges the standard fingering, and takes down the flag rr, i.e., sets the flat rr to "0". The "standard fingering" means that a pianist depresses a black/white key after a stoppage at the rest position.

The motion controller 11 supplies the driving signals ui to the solenoid-operated key actuators 6, and periodically regulates the driving signal ui to proper values of the mean current through comparison between the target key positions on the reference key trajectories and the actual key positions reported from the key sensors 7 and between target key velocity and actual key velocity so as to force the black/white keys 1*a*/1*b* to travel on the reference trajectories. The target key position and target key velocity are hereinafter labeled with "rx" and "rv", and the actual key position and actual key velocity are labeled with "yx" and "yv". Since the end portions are spaced from the rest positions by 10 millimeters in this instance, the key stroke or target key position rv/actual key position yx are fallen within the range from zero to 10 millimeters. On the other hand, the target key velocity rv and actual key velocity yv are fallen within the range from zero to 500 millimeters per second.

On the other hand, the function of the controller 302, which forms a part of the recording system 500, is broken down into a recording controller 12 and a post data processor 13. The hammer sensors 8 supplies hammer position signals, which represent actual hammer positions, to the recording controller 12, and the recording controller 12 determines the final hammer velocity and the time at which the strings 4 are struck with the hammers 3. The recording controller 12 further determines the key numbers assigned to the depressed/released keys 1*a*/1*b*, actual key velocity and time at which the pianist starts to depress the black/white keys 1*a*/1*b*. The recording controller 12 analyzes these pieces of music data representative of the key motion and hammer motion, and supplies pieces of event data to the post data processor 13. The event data express the note-on event and note-off event defined in the MIDI protocols.

The post data processor 13 normalizes the pieces of event data so that the individuality of the automatic player piano is eliminated from the pieces of event data. The pieces of normalized event data are coded by the post data processor 13 in appropriate formats defined in the MIDI protocols.

The key actuators 6 are independently energized with the driving signal ui for pushing the associated black and white keys 1*a*/1*b*. This means that the number of key actuators 6 is equal to the number of black and white keys 1*a*/1*b*. In this instance, the key actuators 6 are implemented by solenoid-operated actuator units.

Each of the solenoid-operated key actuator units 6 includes a plunger 9*a* and a combined structure of solenoids and a yoke 9*b*. The solenoids are housed in the yoke, and plungers 9*a* are projectable from and retractable into the solenoids. The combined structure of solenoids and yoke 9*b* is hereinafter simply referred to as "solenoid 9*b*" or "solenoids 9*b*". The array of solenoid-operated key actuator units 6 is hung from the key bed 102. While the solenoid-operated key actuator units 6 are standing idle without any driving signal ui at an active level, the plungers 9*a* are retracted in the associated solenoids 9*b*, and the tips of the plungers 9*a* are slightly spaced from the lower surfaces of the associated black and white keys 1*a*/1*b* at the rest positions.

When the controller 302 energizes a certain solenoid 9*b* with the driving signal ui, magnetic field is created around the plunger 9*a*, and the magnetic force is exerted on the plunger 9*a* in the magnetic field. Then, the plunger 9*a* upwardly projects from the associated solenoid 9*b*, and pushes the lower surface of the rear portion of black and white key 1*a*/1*b* so as to give rise to the angular motion of the associated black/white keys 1*a*/1*b*. The black/white key 1*a*/1*b* actuates the associated action unit 2, and the jack, which forms a part of the action unit 2, escapes from the hammer 3. The hammer 3 starts the free rotation through the escape, and the string 4 is struck with the hammer 3 at the end of the free rotation. Although the solenoid-operated key actuators 6, black/white keys 1*a*/1*b*, action units 2 and hammers 3 are mechanically independent of one another, the solenoid-operated key actuators 6 sequentially give rise to the key motion, escape of jacks and free rotation of hammers 3, and result in the impacts of the hammers 3 on the strings 4 so as to produce the piano tones.

The black/white keys 1*a*/1*b* are respectively monitored with the key sensors 7. The key sensors 7 are provided under the front portions of the black/white keys 1*a*/1*b*, and have respective detectable ranges overlapped with the full keystrokes. The key sensors 7 create optical beams across the trajectories of the associated black/white keys 1*a*/1*b*, and the amount of light is varied depending upon the actual key position of the associated black/white key 1*a*/1*b*. Thus, the key sensors 7 are categorized in an optical position transducer, and the structure of the key sensors 7 is, by way of example, disclosed in Japanese Patent Publication No. 2923541.

The amount of light is representative of the actual key position, and is converted to photo current. The photo current forms the key position signals yxa representative of the actual key positions, and the key position signals yxa are supplied to the controller 302. The magnitude of the key position signals yxa is varied in dependence on the actual key positions, and the rate of change expresses the key velocity. The key position signals are supplied from the key sensors 7 to both of the recording controller 12 and the motion controller 11 so as to be used in both of the recording and the servo-controlling on the black/white keys 1*a*/1*b* as described hereinbefore.

The hammer sensors 8 are also implemented by an optical position transducer. The optical position transducers disclosed in Japan Patent Application laid-open No. 2001-175262 are available for the hammer sensors 8. The hammer sensors 8 are incorporated in the recording system 500, and the hammer position signals are supplied to the recording controller 12.

Figure 2:
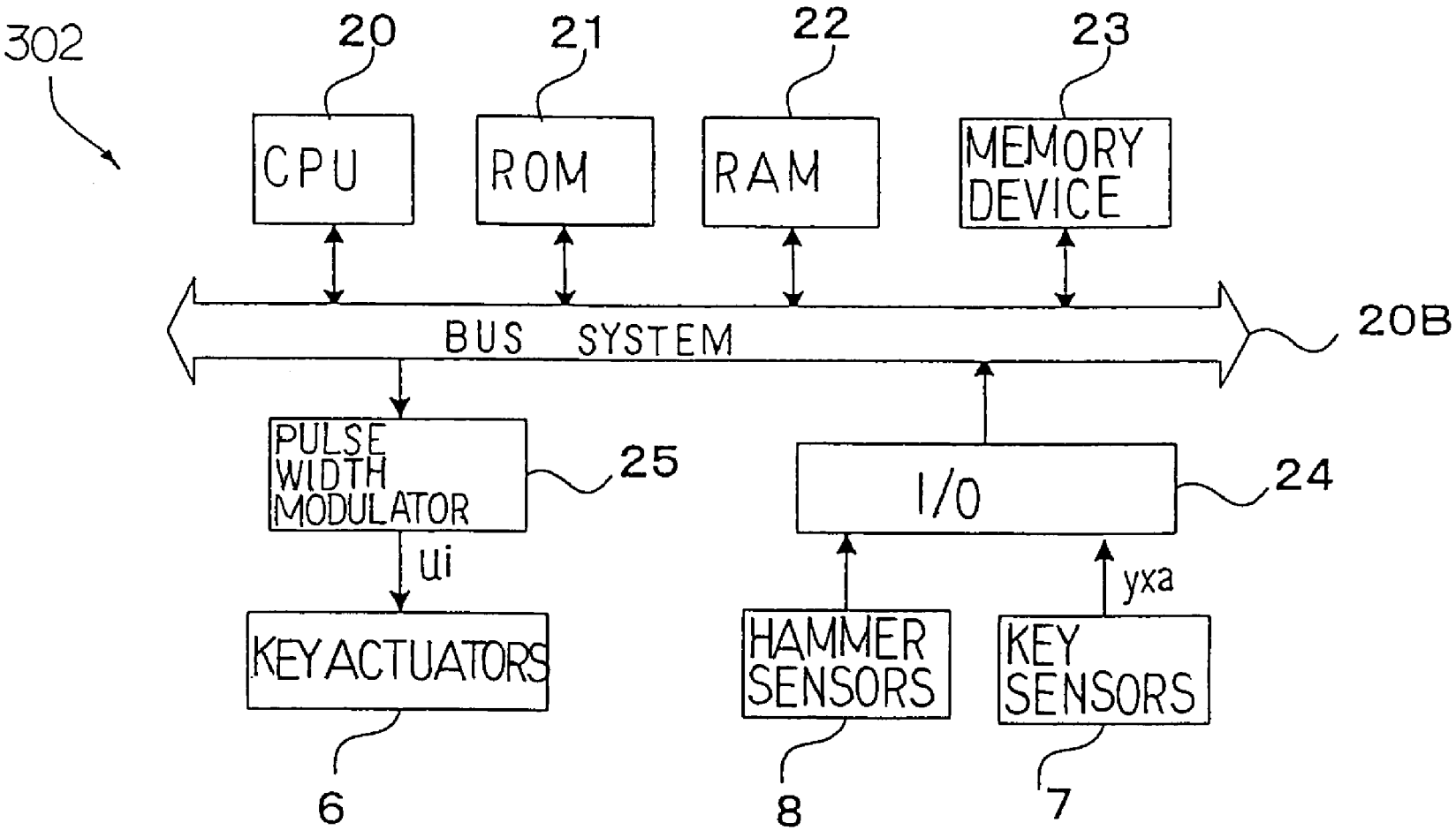
FIG. 2 is a block diagram showing the system configuration of an electric system incorporated in the automatic player piano.

As will be seen in FIG. 2, the controller 302 includes a central processing unit 20, which is abbreviated as "CPU", a read only memory 21, which is abbreviated as "ROM", a random access memory 22, which is abbreviated as "RAM", a bus system 20B, an interface 24, which is abbreviated as "I/O" and a pulse width modulator 25. These system components 20, 21, 22, 24 and 25 are connected to the bus system 20B, and the memory device 23 is further connected to the bus system 20B. Address codes, control data codes and music data codes are selectively propagated from particular system components to other system components through the bus system 20B. Though not shown in FIG. 2, a clock generator and a frequency divider are incorporated in the controller 302, and a system clock signal and a tempo clock signal make the system components synchronized with one another and various timer interruptions take place.

The central processing unit 20 is the origin of the data processing capability. A main routine program, subroutine programs and data/parameter tables are stored in the read only memory 21, and the computer programs runs on the central processing unit 20 so as to accomplish the jobs as the preliminary data processor 10, motion controller 11, recording controller 12 and post data processor 13. One of the data tables is used for determining a feedback gain kx and kv as will be hereinlater described in detail, and is hereinafter referred to as "gain table". Another data table is used for determining an addend u, and is hereinafter referred to as "addend table". The random access memory 22 offers a temporary data storage, and serves as a working memory.

The memory device 23 offers a large amount of memory to both automatic playing and recording systems 300/500. The music data codes are stored in the memory device 23 in the recording and playback. In this instance, the memory device 23 is implemented by a hard disk driver. A flexible disk driver or floppy disk (trademark) driver, a compact disk driver such as, for example, a CD-ROM driver, a magnetic-optical disk driver, a ZIP disk driver, a DVD (Digital Versatile Disk) driver and a semiconductor memory board are available for the systems 300/500.

The hammer sensors 8, key sensors 7 and manipulating panel (not shown) are connected to the interface 24, and the pulse width modulator 25 distributes the driving signal ui to the solenoid-operated key actuators 6. The key position signals yxa and hammer position signals are continuously supplied from the key sensors 7 and hammer sensors 8 to the interface 24. Analog-to-digital converters A/D (see FIG. 3) are incorporated in the interface 24 so as to convert the hammer position signals and key position signals yxa to digital hammer position signals and digital key position signals yxd. The system clock signal periodically gives rise to a timer interruption for the central processing unit 20 so that the central processing unit 20 periodically fetches the pieces of positional data representative of the actual key positions and pieces of positional data representative of the actual hammer positions from the interface 24. The controller 302 may further include a communication interface, to which music data codes are supplied from a remote data source through a public communication network.

The driving signal ui is produced in the pulse width modulator 25, and is supplied to the solenoid-operated key actuators 6. The pulse width modulator 25 is responsive to a control signal, which is supplied from the central processing unit 20 so as to vary the mean current or duty ratio of the driving signal ui. Since the magnetic force is proportional to the mean current of the driving signal ui, it is possible to control the plunger velocity with the driving signal ui. In this instance, the central processing unit 20, pulse width modulator 25, key actuators 6, key sensors 7 and interface 24 forms a servo-control loop 304, and the black and white keys 1*a*/1*b* are inserted into the servo-control loop 304.

Servo Control

Figure 3:
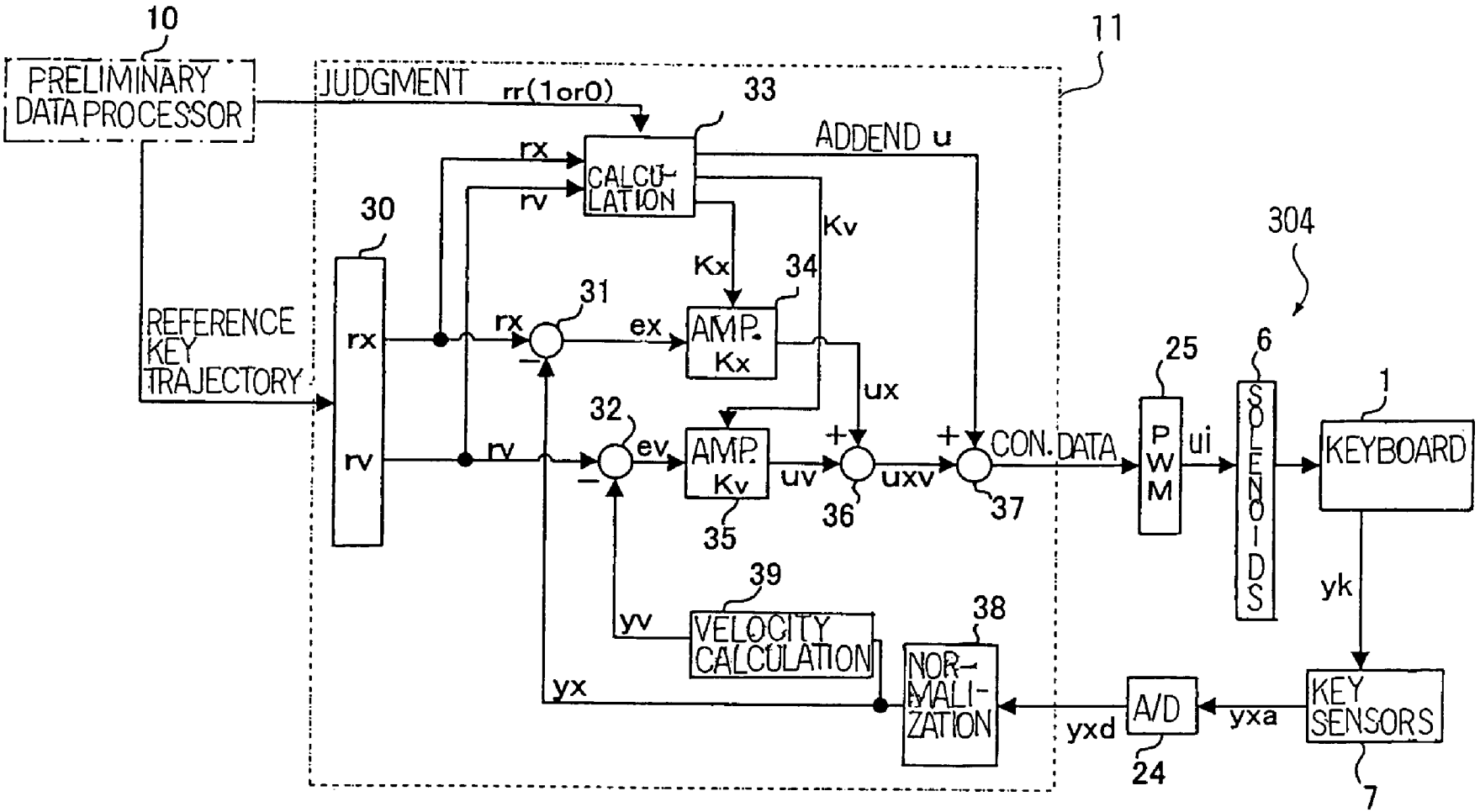
FIG. 3 is a block diagram showing the functions of a servo-control loop for black and white keys 1*a*/1*b*.

FIG. 3 shows the function of the motion controller 11 for the servo control on the black/white keys 1*a*/1*b*. In this instance, the motion controller 11 is implemented by the software.

In FIG. 3, circles 31 and 32 stand for subtractors, and circles 36 and 37 represent adders. The subtractor 31 determines a positional deviation between the target key position rx and the actual key position yx, and the other subtractor 32 determines a velocity deviation between the target key velocity rv and the actual key velocity yv.

Box 24 represents the analog-to-digital converter A/D incorporated in the interface 24, and box 30 stands for the determination of the target key position rx and target key velocity rv at each time period. The central processing unit 20 fetches the digital key position signals yxd from the analog-to-digital converter 24 once in each sampling time period, and the data fetching is repeated at intervals of 1 millisecond. The sampling time period is equal to "each time period", and, accordingly, "each time period" is equal to 1 millisecond. The target key position rx is supplied from the preliminary data processor 10, and the target key velocity rv is determined through the differentiation on a series of values of target key position rx.

Box 33 represents a calculator for gains and added. The calculator 33 analyzes the target key position rx, and determines a value of position gain kx and a value of velocity gain kv on the basis of the target key position rx and target key velocity rv. The calculator 33 is further responsive to the flag rr, which represents the sort of key motion, i.e., the full-stroke or half-stroke, so as to determine an addend u. The position gain kx and velocity gain kv have influence on the response characteristics of the servo-control loop 304, and the response characteristics are optimized to the fingering with the addend u. In this instance, the central processing unit 20, computer program, gain table and addend table realize the calculator 33.

Boxes 34 and 35 stand for amplifiers. The amplifier 34 multiplies the positional deviation ex by the position gain kx, and the other amplifier multiplies the velocity deviation ev by the velocity gain kv. The products ux and uv represent a certain percentage of the mean current and another certain percentage of the mean current, respectively. Thus, the boxes 34 and 35 converts the stroke in millimeter and velocity in millimeter per second to a percentage due to the key position and another percentage due to the key velocity. The products ux and uv are added to one another at the adder 36, and the addend u is further added to the sum uxv, i.e., (ux+uv) at the adder 37. The total sum (ux+uv+u) is supplied from the adder 37 to the pulse width modulator 25 as the control data, and the pulse width modulator 25 adjusts the duty ratio to the total sum. Thus, the motion controller 11 optimizes the response characteristics of servo-control loop 304 depending upon not only the positional deviation ex and velocity deviation ev but also the flag rr. This results in high fidelity in the automatic playing.

Boxes 25 and 38 stand for the function of the pulse width modulator 25 and normalization, respectively. Box 39 stands for a velocity calculator, which determines a value of the actual key velocity yv on the basis of a predetermined numbers of values of actual key positions on the actual key trajectory.

FIGS. 4 and 5 shows the gain table and addend table. When the preliminary data processor 10 categorizes the key motion into the half-stroke, the flag rr is set to 1, and the central processing unit 20 accesses the gain table and addend table shown in FIG. 4. On the other hand, when the preliminary data processor 10 categorizes the key motion into the full-stroke, the flag rr is taken down, i.e., rr=0, and the central processing unit 20 reads out the position gain kx, velocity gain kv and addend u from the gain table and addend table shown in FIG. 5. In this instance, the gain table and addend table are stored in the read only memory 21 as described hereinbefore. Those tables may be stored in the memory device 23, and are transferred from the memory device 23 to the random access memory 22 upon entry into the subroutine program for the automatic playing. The manufacturer determined the position gain kx, velocity gain kv and addend u through experiments, and stored the position gain kx, velocity gain kv and addend u in the read only memory 21 or memory device 23 before delivery to the user.

The central processing unit 20 is assumed to find the target key position rv, target key velocity rv and flat rr to be equal to or less than 5 millimeters, equal to or less than 200 millimeters per second and equal to 1. The key motion is categorized in the half-stroke, and the black/white key 1*a*/1*b* is to be moved at relatively low speed. Then, the central processing unit 20 accesses the gain table and addend table shown in FIG. 4 with the target key position rv of 0 to 5 millimeters, target key velocity rv equal to or less than 200 millimeters per second and flag of 1, and reads out the position gain kx of 0.1, velocity gain kv of 0.2 and addend u of 15 percent from the leftmost column of the gain and addend tables. However, if the target key position rx is fallen within the range between 5 millimeters to 10 millimeters, the central processing unit 20 reads out the position gain kx of 0.1, velocity gain kv of 0.4 and addend of (9+4×rv/100) percent as shown in the second column of the tables.

If, on the other hand, the black/white key 1*a*/1*b* is to be moved at relatively high speed, i.e., greater than 200 millimeters per second, the central processing unit 20 accesses the right columns of the gain and addend tables shown in FIG. 4. If the target key position rx is fallen within the range from zero to 4 millimeters, the central processing unit 20 reads out the position gain kx of 0.6, velocity gain kv of 0.3 and addend of (9+2×(rv−100)/100) % from the third column of the gain and addend tables. However, if the central processing unit 20 finds the target key position rx between 4 millimeters and 10 millimeters, the central processing unit 20 reads out the position gain kx of 0.15, velocity gain kv of 0.4 and addend of (9+2×(rv−100)/100) % from the fourth column of the gain and addend tables.

On the other hand, when the preliminary data processor 10 categorizes the key motion in the full-stroke, the central processing unit 20 accesses the gain and addend table shown in FIG. 5. The central processing unit 20 is assumed to find a black/white key 1*a*/1*b* to be moved at relatively low speed equal to or less than 100 millimeters per second. The central processing unit 20 reads out the position gain kx, velocity gain kv and addend u selectively from the first and second columns of the gain and addend tables depending upon the keystroke. If the target key position rx is fallen within the range from zero to 4 millimeters, the central processing unit 20 reads out the position gain kx of 0.6, velocity gain kv of 0.3 and added u of 9% from the first column of the gain and addend tables. On the other hand, if the target key position rx is fallen within the range between 4 millimeters and 10 millimeters, the central processing unit 20 reads out the position gain of 0.2, velocity gain kv of 0.3 and addend of 9% from the second column of the gain and addend tables.

The central processing unit 20 is assumed to find a black/white key 1*a*/1*b* to be moved at relatively high speed greater than 100 millimeters per second. The central processing unit 20 reads out the position gain kx, velocity gain kv and addend u selectively from the third and fourth columns of the gain and addend tables depending upon the keystroke. If the target key position rx is fallen within the range from zero to 4 millimeters, the central processing unit 20 reads out the position gain kx of 0.6, velocity gain kv of 0.3 and added u of (9+2×(rv−100)/100) % from the third column of the gain and addend tables. On the other hand, if the target key position rx is fallen within the range between 4 millimeters and 10 millimeters, the central processing unit 20 reads out the position gain of 0.2, velocity gain kv of 0.3 and addend of (9+2×(rv−100)/100) % from the fourth column of the gain and addend tables.

The gain and addend tables shown in FIGS. 4 and 5 are prepared on the basis of the following facts. While a solenoid-operated key actuator is repeating a tone in the half-stroke, the key motion tends to be unstable, and the servo-control is liable to be broken. Especially, the solenoid-operated key actuator is expected to direct the black/white key 1*a*/1*b* toward the end position in the shallow region of the reference key trajectory, i.e., the keystroke equal to or less than 5 millimeters. If the response characteristics are too strong at the relatively low speed, i.e., rv is equal to or less than 200 millimeters per second, the key motion becomes seriously unstable. For this reason, the velocity gain kv and position gain rx are to be small in value. However, the servo-control loop 304 has to cause the black/white key 1*a*/1*b* surely to proceed toward the end position through the reversal. The large addend u causes the plunger 9*a* strongly to push the rear portion of the black/white key 1*a*/1*b* so that the black/white key 1*a*/1*b* surely changes the direction of key motion. As a result, the solenoid-operated key actuators 6 exactly reproduces the repetition without difference in loudness and noise due to the impact of the plungers 9*a* on the black/white keys 1*a*/1*b*.

On the other hand, while the black/white key 1*a*/1*b* is traveling in the deep region at the relatively low velocity, the large velocity gain kv is given to the servo-control loop 304, and the addend u is varied together with the target velocity rv, i.e., (9+4×rv/100). As a result, the response characteristics becomes sensitive to the velocity difference ev, and the black/white key 1*a*/1*b* is forced to travel on the reference key velocity.

As will be understood, the foregoing description, while the black/white keys 1*a*/1*b* are traveling in the shallow regions, i.e., between zero to 5 millimeters on the reference key trajectories expressing the repetition at a relatively low velocity equal to or less than 200 millimeters per second, the servo-control loop 304 according to the present invention forces the black/white keys 1*a*/1*b* surely to turn by virtue of the large addend u. On the other hand, when the black/white keys 1*a*/1*b* enters the deep regions, i.e., between 5 millimeters and 10 millimeters, the servo-control loop 304 enhances the response characteristics by virtue of the large velocity gain kv. This results in the reproduction of key motion at high fidelity. Thus, the servo-control loop 304 according to the present invention exhibits the variable response characteristics depending upon the depth of the black/white keys 1*a*/1*b* in the reproduction of the repetition at the relatively low key velocity.

Description is hereinafter made on the servo-control on a black/white key 1*a*/1*b*. The motion controller 11 applies the following servo-control to all the black and white keys 1*a*/1*b* in a time-sharing fashion so that the servo-control on the other black/white keys 1*a*/1*b* are analogous to that on the black/white key 1*a*/1*b*.

When the user energizes the automatic player 300, the key sensors 7 starts to monitor the associated black and white keys 1*a*/1*b*. The key sensor 7, which monitors the certain black/white key 1*a*/1*b*, supplies the analog key position signal yxa indicative of the actual key position yk to the interface 24, and the analog-to-digital converter A/D convert the potential level of the analog key position signal yxa to a series of discrete values. The discrete values are coded, and the central processing unit 20 periodically fetches the digital key position signal yxd or discrete values from the interface 24.

The digital key position signal yxd is subjected to the box 38, and is subjected to a normalization. The pieces of positional data, which are represented by the digital key position signal yxd, are expressed in millimeters, and the individuality of the key sensor 7 is eliminated from the pieces of positional data. Thus, the normalized key position signal yx is output from the box 38, and is supplied to the subtractor 31. The normalized key position signal yx is representative of the actual key position, and is also labeled with "yx".

The normalized key position signal yx is further supplied to the box 39, and the actual key velocity yv is calculated on the basis of the actual key position yx. The differentiation is carried out on the actual key position yx. The key velocity may be determined at a certain point on the actual key trajectory as follows. First, three values of actual key position before the certain value and three values of actual key position after the certain value are read out from the random access memory. Subsequently, the seven values of actual key position are approximated to a quadratic curve, and the tangential line is determined at the certain value. A digital key velocity signal yv, which is representative of the actual key velocity also labeled with "yv", is supplied from the box 39 to the subtractor 32.

On the other hand, the preliminary data processor 10 determines the reference key trajectory for the black/white key 1*a*/1*b*, and the target key position is intermittently supplied from the preliminary data processor 10 to the box 30. The target key velocity rv is calculated on the basis of the target key position rx, and the target key position rx and target key velocity rv are supplied from the box 30 to the subtractors 31 and 32, respectively. Since the target key position rx and target key velocity rv are recalculated at the intervals equal to the sampling intervals on the digital key position signal yxd, the target key position rx and target key velocity rv are renewed synchronously with the actual key position yx and actual key velocity yv.

When the preliminary data processor 10 determines the reference key trajectory, the preliminary data processor 10 compares the reference key trajectory with the previous reference key trajectory to see whether the key motion is categorized in the full-stroke or the half-stroke. If the reference key trajectory crosses the previous reference key trajectory, the preliminary data processor 10 categorizes the key motion to be reproduced in the half-stroke, and raises the flag rr indicative of "1". On the other hand, when the preliminary reference key trajectory is spaced from the previous reference key trajectory, the preliminary data processor 10 categorizes the key motion to be reproduced in the full-stroke, and keeps or take the flag rr down. The status of the flag rr is supplied to the box 33.

Since the target key position rx and target key velocity rv are further supplied from the box 30 to the box 33, the position gain kx, velocity gain kv and addend u are read out from the gain and addend tables, and are supplied from the box 33 to the boxes 34 and 35 and the adder 37.

The position deviation ex and velocity deviation ev are determined at the subtractors 31 and 32, and are supplied to the boxes 34 and 35, respectively. The deviations ex and ev are multiplied with the position gain kx and velocity gain kv, respectively, and the products ux and uv are supplied from the boxes 34 and 35 to the adder 36. As described hereinbefore, the products ux and uv are indicative of the percentage of the duty ratio so that the sum uxv is also indicative of the percentage of the duty ratio. The addend u is also indicative of the percentage of the duty ratio, and is added to the sum of products uxv. Thus, a piece of control data representative of the target duty ratio is supplied from the adder 37 to the pulse width modulator 25.

The pulse width modulator 25 adjusts the driving signal ui to the target duty ratio, and the driving signal ui is supplied from the pulse width modulator 25 to the solenoid-operated key actuator 6 associated with the black/white key 1*a*/1*b*. The solenoid-operated key actuator 6 exerts the force on the rear portion of the black/white key 1*a*/1*b*, and the black/white key 1*a*/1*b* is further moved. The key sensor 7 changes the key position signal yxa, and the motion controller 11 is informed of the new value of actual key position yk.

Thus, the above-described control sequence is repeated by the servo-control loop 304 until the black/white key 1*a*/1*b* reaches the end of the reference key trajectory, and the key motion of the black/white key 1*a*/1*b* is reproduced through the servo-control loop 304.

Figure 6:
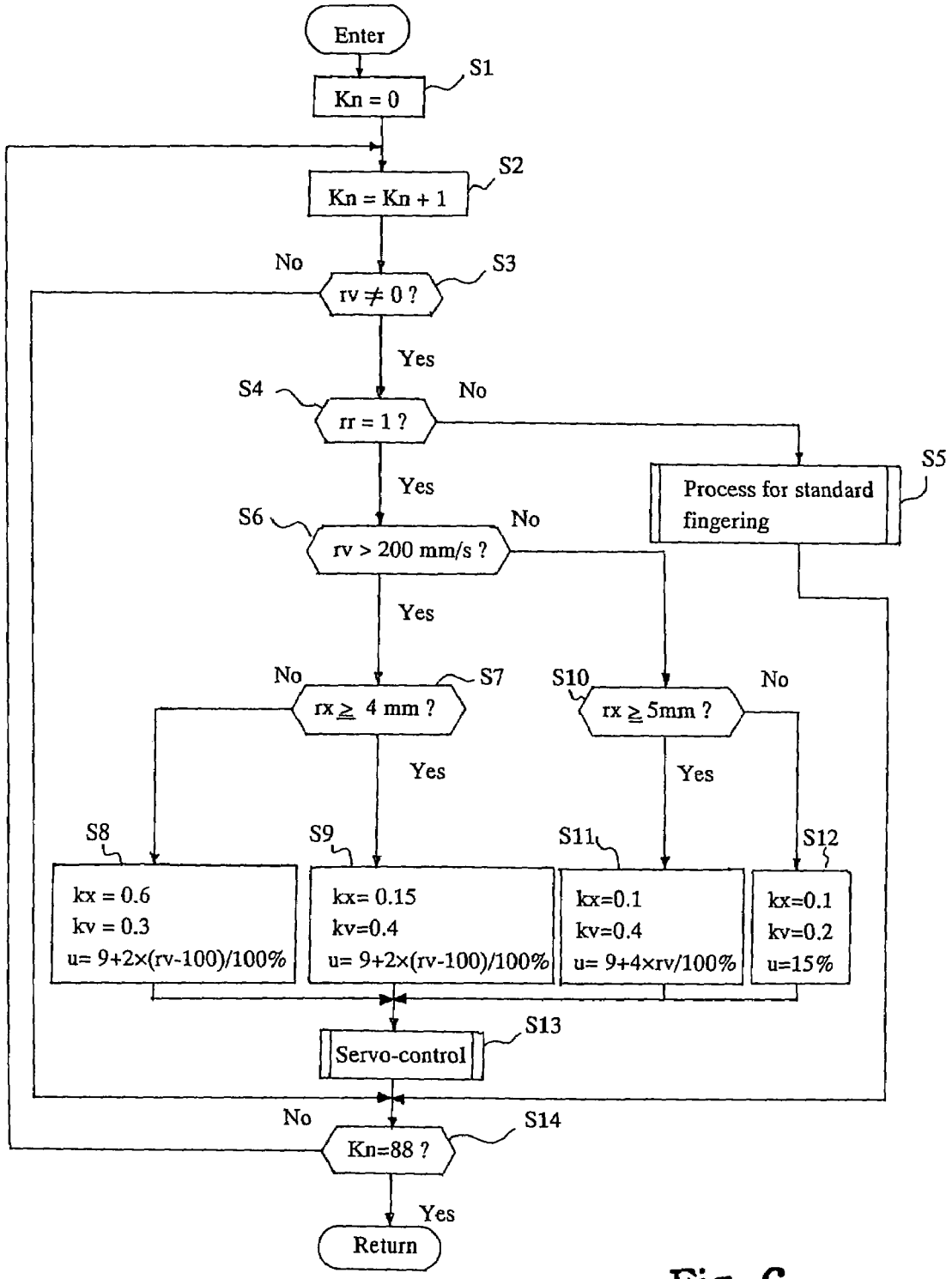
FIG. 6 is a flowchart showing a sequence of jobs for determining gains and addend in the half-stroke.
Figure 7:
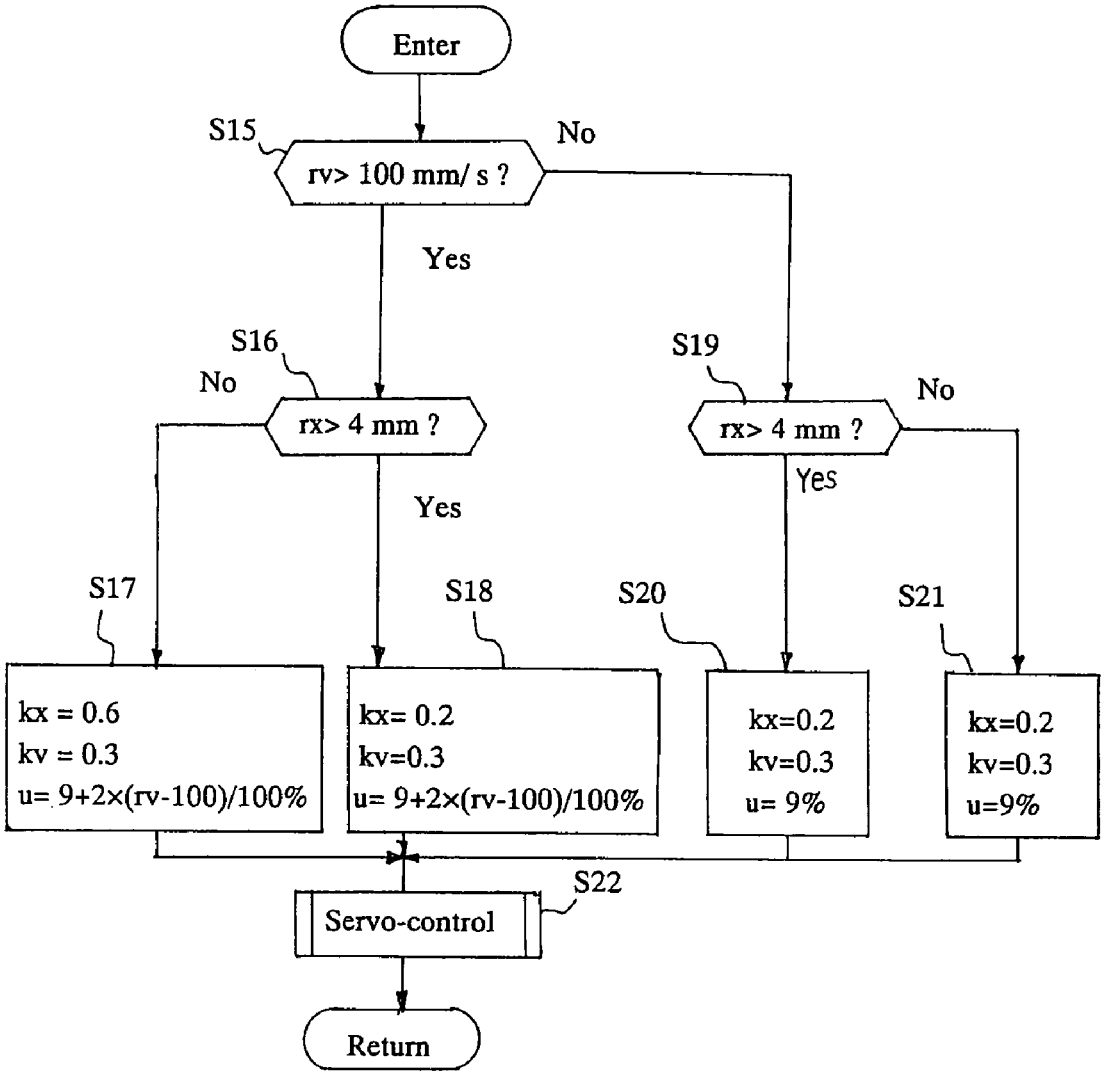
FIG. 7 is a flowchart showing a sequence of jobs for determining gains and addend in the full-stroke.

FIGS. 6 and 7 show the computer program for the calculation at the box 33. The central processing unit 20 periodically enters the subroutine program for the calculation at the box 33. A user is assumed to instruct the automatic player 300 to reenact a performance expressed by a set of music data codes. The central processing unit 20 firstly resets a key number register to zero as by step S1. The key numbers Kn are respectively assigned the black and white keys 1*a*/1*b*, and the key number Kn stored in the key number register is indicative of the black/white key 1*a*/1*b* under the servo-control.

The central processing unit 20 increments the key number Kn by one as by step S2. When the central processing unit 20 accomplishes the job at step S2 immediately after the step S1, the key number Kn is "1", and is indicative of the leftmost white key 1*b* on the keyboard 1. Thus, the eighty-eight black and white keys 1*a*/1*b* successively come under the servo-control.

Upon completion of the job at step S2, the central processing unit 20 checks the target key velocity rv to see whether or not the black/white key 1*a*/1*b* is traveling on the reference key trajectory as by step S3. When the target key velocity rv is equal to zero, the answer at step S3 is given negative "No", and the central processing unit 20 proceeds to step S14. The central processing unit 20 checks the key number register to see whether or not the rightmost white key 1*b* has been already controlled at step S14. If the answer is given negative "No", the central processing unit 20 returns to step S2, and increments the key number Kn, again. On the other hand, if the answer at step S14 is given affirmative "Yes", the central processing unit 20 returns to the subroutine program for the automatic playing.

If, on the other hand, the black/white key 1*a*/1*b* is traveling on the reference key trajectory or gets ready for traveling, the target key velocity rv is greater than zero, and the answer at step S3 is given affirmative "Yes". With the positive answer "Yes", the central processing unit 20 checks the flag rr to see whether or not the key motion is categorized in the half-stroke as by step S4. If the preliminary data processor 10 has categorized the key motion in the standard fingering, the status data "0" is supplied to the motion controller 10, and the answer at step S4 is given negative "No". With the negative answer, the central processing unit 20 proceeds to step S5, and accomplishes jobs for the standard fingering. The jobs for the standard fingering will be hereinlater described with reference to FIG. 7.

The preliminary data processor 10 is assumed to have categorized the key motion in the half-stroke. The status data "1" is supplied to the motion controller 11, and the answer at step S4 is given affirmative "Yes". With the positive answer, the central processing unit 20 checks the target velocity rv to see whether the black/white key 1*a*/1*b* is to be moved at a high speed or a low speed as by step S6.

When the target key velocity rv is greater than 200 millimeters per second, the answer at step S6 is given affirmative "Yes", and the central processing unit checks the target key position rx to see whether or not the black/white key 1*a*/1*b* enters the deep region as by step S7. If the target key position rx is less than 4 millimeters, the black/white key 1*a*/1*b* is still traveling in the shallow region, and the answer at step S7 is given negative "No". With the negative answer "No", the central processing unit 20 reads out the position gain kx of 0.6, velocity gain kv of 0.3 and addend u given as (9+2×(rv−100)/100%) from the gain and addend tables as by step S8. On the other hand, when the black/white key 1*a*/1*b* travels in the deep region, the answer at step S7 is given affirmative "Yes", and the central processing unit 20 reads out the position gain kx of 0.15, velocity gain kv of 0.4 and addend u given as (9+2×(rv−100)/100%) from the gain and addend tables as by step S9.

If, on the other hand, when the target key velocity rv is equal to or less than 200 millimeters per second, the answer at step S6 is given negative "No", and the central processing unit 20 checks the target position rx to see whether or not the black/white key 1*a*/1*b* enters the deep region as by step S10. If the target key position rx is less than 5 millimeters, the black/white key 1*a*/1*b* is still traveling in the shallow region, and the answer at step S10 is given negative "No". With the negative answer "No", the central processing unit 20 reads out the position gain kx of 0.1, velocity gain kv of 0.2 and addend u of 15% from the gain and addend tables as by step S12. On the other hand, when the black/white key 1*a*/1*b* travels in the deep region, the answer at step S10 is given affirmative "Yes", and the central processing unit 20 reads out the position gain kx of 0.1, velocity gain kv of 0.4 and addend u given as (9+4×rv/100%) from the gain and addend tables as by step S11.

Thus, the central processing unit 20 determines the position gain kx, velocity gain kv and addend u at one of steps S8 to S12 depending upon the combination of target key velocity rv and target key position rx. Upon completion of the jobs at step S8, S9, S11 or S12, the central processing unit 20 proceeds to step S13, and regulates the driving signal ui to the duty ratio (uxv+u).

Subsequently, the central processing unit 20 proceeds to step S14, and checks the key number register to see whether or not the servo-control has been accomplished for the rightmost white key 1*b*. The central processing unit 20 returns to step S2 or subroutine program for the automatic playing depending upon the answer at step S14.

The preliminary data processor 10 is assumed to have already categorized the key motion in the full-stroke. The flag rr has been already taken down to zero, and the answer at step S4 is given negative. Then, the central processing unit 20 enters the subroutine program for the standard fingering shown in FIG. 7.

The he central processing unit 20 checks the target velocity rv to see whether the black/white key 1*a*/1*b* is to be moved at a high speed or a low speed as by step S15.

When the target key velocity rv is greater than 100 millimeters per second, the answer at step S15 is given affirmative "Yes", and the central processing unit 20 checks the target key position rx to see whether or not the black/white key 1*a*/1*b* enters the deep region as by step S16. If the target key position rx is less than 4 millimeters, the black/white key 1*a*/1*b* is still traveling in the shallow region, and the answer at step S16 is given negative "No". With the negative answer "No", the central processing unit 20 reads out the position gain kx of 0.6, velocity gain kv of 0.3 and addend u given as (9+2×(rv−100)/100%) from the gain and addend tables as by step S17.

On the other hand, when the black/white key 1*a*/1*b* travels in the deep region, the answer at step S16 is given affirmative "Yes", and the central processing unit 20 reads out the position gain kx of 0.2, velocity gain kv of 0.3 and addend u given as (9+2×(rv−100)/100%) from the gain and addend tables as by step S18.

If, on the other hand, when the target key velocity rv is equal to or less than 100 millimeters per second, the answer at step S15 is given negative "No", and the central processing unit 20 checks the target position rx to see whether or not the black/white key 1*a*/1*b* enters the deep region as by step S19. If the target key position rx is less than 4 millimeters, the black/white key 1*a*/1*b* is still traveling in the shallow region, and the answer at step S19 is given negative "No". With the negative answer "No", the central processing unit 20 reads out the position gain kx of 0.2, velocity gain kv of 0.3 and addend u of 9% from the gain and addend tables as by step S21. On the other hand, when the black/white key 1*a*/1*b* travels in the deep region, the answer at step S19 is given affirmative "Yes", and the central processing unit 20 reads out the position gain kx of 0.2, velocity gain kv of 0.3 and addend u given as 9% from the gain and addend tables as by step S20.

Upon completion of the jobs at step S17, S18, S20 or S21, the central processing unit 20 supplies the target duty ratio (uxv+u) to the pulse width modulator 25, and instructs the pulse width modulator 25 to keep or vary the duty ratio of the driving signal as by step S22. Upon completion of the job at step S22, the central processing unit 20 proceeds to step S14.

As will be appreciated from the foregoing description, the motion controller 11 according to the present invention determines the gains kv and kx and addend u differently depending upon the sort of key motion. As a result, the servo-control loop 304 prevents the black and white keys 1*a*/1*b* from unintentional actions, and the key motion is reproduced at high fidelity. This results in the playback close to the original performance.

Although particular embodiments of the present invention have been shown and described, it will be apparent to those skilled in the art that various changes and modifications may be made without departing from the spirit and scope of the present invention.

The optical transducers do not set any limit to the technical scope of the present invention. For example, another sort of position sensor, which may be implemented by a potentiometer, may be incorporated in the automatic player. The optical transducer may be replaced with a combination of a piece of permanent magnet and a Hall element as the key sensors 7 and/or hammer sensors 8. Otherwise, a semiconductor acceleration sensor may be formed on a semiconductor chip attached to the black and white keys 1*a*/1*b* and hammers 3. The semiconductor acceleration sensor may be implemented by a weight piece supported by beams where resistors are formed as the parts of the Wheatstone bridge. Thus, the key sensors and hammer sensors may directly convert the key velocity/hammer velocity or the acceleration to electric signals.

In case where the velocity sensor is employed, the actual key position is determined through the integration on a series of values of actual key velocity. Similarly, in case where the acceleration sensor is employed, the actual key velocity is determined through the integration on a series of values of actual key acceleration, and the actual key position is determined through the integration on a series of values of actual key velocity.

The pulse width modulator does not set any limit to the technical scope of the present invention. The potential level of the driving signal ui may be directly controlled through a voltage transformer.

The gain table and addend table shown in FIGS. 4 and 5 do not set any limit to the technical scope of the present invention. The gain and addend tables shown in FIGS. 4 and 5 are suitable for a certain type of the automatic player piano. This means that another type of automatic player piano requires another gain table and another addend table for the different sorts of fingering. Of course, in case where the keystroke is different from 10 millimeters, the manufacturer carries out the experiments for the different keyboard. Moreover, the position gain kx, velocity gain kv and addend u may be expressed individual equations so that the central processing unit calculates them by using these equations.

The actual key position yx and actual key velocity yv may be supplied to the box 33. In this instance, the central processing unit 20 does not take the target velocity rv and target position rx into account, and reads out the position gain kx, velocity gain kv and addend u depending upon the combination of actual key position yx, actual key velocity yv and flag information rr.

The method for categorizing the key motion does not set any limit on the technical scope of the present invention. The central processing unit 20 accumulates the values of actual key positions representative of the actual key trajectories in the working memory 22, and analyzes the key actual key trajectories for categorizing the key motion.

The half-stroke does not uniquely correspond to the repetition. A pianist may keep the released key at a certain point on the upward path in the shallow region for a moment. Since the reference key trajectory does not cross the previous reference key trajectory, the key motion is categorized in the standard fingering. However, the key motion exhibits the uniqueness of the half-stroke. For this reason, the key motion is to be reproduced as the half-stroke. Thus, the key motion is categorized in the half-stroke in so far as the key motion is continued through the reversal regardless of the time interval between the reference key trajectories. From this viewpoint, if the released black/white key 1*a*/1*b* is depressed within a certain time period measured from the departure from the end position, the key motion is to be categorized in the half-stroke, and the flag rr is to be raised. The certain time period may be 100 milliseconds. The central processing unit 20 determines the arrival at the end position on the basis of the actual key positions reported from the key sensors 7, and starts a timer. If the reversal takes place within the certain time period, the central processing unit 20 raises the flag rr. The certain time period is also varied together with the model of pianos.

The key acceleration may be taken into the servo-control. In this instance, an acceleration gain is stored in the gain table, and a deviation between a target acceleration and an actual acceleration is multiplied by the acceleration gain. In case where the acceleration is taken into account together with the position and velocity, the target key acceleration and actual key acceleration are determined on the basis of the target key velocity rv and actual key velocity yv through the differentiation, and the deviation therebetween is calculated at a third subtractor. The acceleration deviation is multiplied by the acceleration gain, and the product is added to the other products. The addend is further added to the sum of products, and determines the target duty ratio.

The servo-control loop 304 may be implemented by a logic circuit. A suitable digital signal processor may be incorporated in the automatic player for the signal processing.

The grand piano 100 does not set any limit to the technical scope of the present invention. The grand piano may replaced with an upright piano. The automatic player 300 according to the present invention may be installed in another sort of keyboard musical instrument such as, for example, a harpsichord, an organ and a mute piano. Moreover, the automatic player according to the present invention may be installed in another sort of musical instrument such as, for example, a celesta.

The component parts of the above-described embodiment are correlated with claim languages as follows. The black and white keys 1*a*/1*b* are corresponding to "plural manipulators", and the action units 2, hammers 3 and strings 4 as a whole constitute a "tone generator". The key sensors 7 and solenoid-operated key actuators 6 are corresponding to "plural sensors" and "plural actuators", respectively. The key position signals yxa/yxd/yx and driving signals ui serves as a "detecting signal" and a "driving signal", and "physical quantity" stands for the key position, i.e., keystroke and the key velocity. The addend u is corresponding to a "fundamental component", and the sum of position gain kx and velocity gain kv serves as a "loop gain component". The full-stroke and half-stroke are respectively corresponding to "first sort of motion", and "second sort of motion".

The subtraction at the circles 31/32 is equivalent to "comparison" between a target value and an actual value. The mean current or duty ratio is equivalent to a "magnitude".

What is claimed is:

1. An automatic player musical instrument for producing tones, comprising:

an acoustic musical instrument including plural manipulators selectively moved for specifying the pitch of said tones, and a tone generator connected to said plural manipulators and responsive to motion of said plural manipulators for producing said tones at the specified pitch; and an automatic player including plural sensors for producing detecting signals representative of a physical quantity expressing said motion, plural actuators selectively energized with a driving signal so as to give rise to said motion of said plural manipulators, and a controller connected to said plural sensors and said plural actuators for forming a servo-control loop and forcing said plural manipulators to travel on reference trajectories with said driving signal, the magnitude of which contains a loop gain component representative of response characteristics of said servo-control loop and a fundamental component representative of a constant load to be exerted on said plural manipulators, said controller categorizing said motion in a first sort of motion in which said plural manipulators change the direction of motion through a reversal longer than a critical time period or a second sort of motion in which said plural manipulators change the direction of motion through said reversal equal to or shorter than said critical time period, said controller enlarging said fundamental component around said reversal in said second sort of motion so as to keep said motion stable.

2. The automatic player musical instrument as set forth in claim 1, in which said controller reduces said loop gain component around said reversal in said second sort of motion.

3. The automatic player musical instrument as set forth in claim 2, in which said controller checks a velocity of each manipulator to see whether said each manipulator travels at a low speed or a high speed, wherein said controller enlarges said fundamental component and reduces said loop gain component when said each manipulator travels at a low speed.

4. The automatic player musical instrument as set forth in claim 3, in which a criterion between said low speed and said high speed is 200 millimeters per second.

5. The automatic player musical instrument as set forth in claim 2, in which said controller enlarges said loop gain component without the enlargement of said fundamental component when said plural manipulators travel in a region spaced from said reversal.

6. The automatic player musical instrument as set forth in claim 5, in which a boundary between said region and another region around said reversal is found at the middle point on said reference trajectory.

7. The automatic player musical instrument as set forth in claim 1, in which a full-stroke and a half-stroke are respectively categorized in said first sort of motion and said second sort of motion.

8. The automatic player musical instrument as set forth in claim 7, in which said reversal takes place at a certain point on the way to a rest position in said half-stroke.

9. The automatic player musical instrument as set forth in claim 1, in which said critical time period is of the order of 100 milliseconds.

10. The automatic player musical instrument as set forth in claim 1, in which said acoustic musical instrument is a piano so that black and white keys and a combination of action units, hammers and strings serve as said plural manipulators and said tone generator, respectively.

11. The automatic player musical instrument as set forth in claim 10, in which each of said black and white keys is moved by means of one of said plural actuators, and is monitored with one of said plural sensors.

12. An automatic player for a musical instrument having plural manipulators and a tone generator, comprising plural sensors for producing detecting signals representative of a physical quantity expressing motion of said plural manipulators, plural actuators selectively energized with a driving signal so as to give rise to said motion of said plural manipulators, and a controller connected to said plural sensors and said plural actuators for forming a servo-control loop and forcing said plural manipulators to travel on reference trajectories with said driving signal, the magnitude of which contains a loop gain component representative of response characteristics of said servo-control loop and a fundamental component representative of a constant load to be exerted on said plural manipulators, said controller categorizing said motion in a first sort of motion in which said plural manipulators change the direction of motion through a reversal longer than a critical time period or a second sort of motion in which said plural manipulators change the direction of motion through said reversal equal to or shorter than said critical time period, said controller enlarging said fundamental component around said reversal in said second sort of motion so as to keep said motion stable.

13. The automatic player as set forth in claim 12, in which said controller reduces said loop gain component around said reversal in said second sort of motion.

14. The automatic player as set forth in claim 13, in which said controller checks a velocity of each manipulator to see whether said each manipulator travels at a low speed or a high speed, wherein said controller enlarges said fundamental component and reduces said loop gain component when said each manipulator travels at a low speed.

15. The automatic player as set forth in claim 14, in which a criterion between said low speed and said high speed is 200 millimeters per second.

16. The automatic player as set forth in claim 13, in which said controller enlarges said loop gain component without the enlargement of said fundamental component when said plural manipulators travel in a region spaced from said reversal.

17. The automatic player as set forth in claim 16, in which a boundary between said region and another region around said reversal is found at the middle point on said reference trajectory.

18. The automatic player as set forth in claim 12, in which a full-stroke and a half-stroke are respectively categorized in said first sort of motion and said second sort of motion.

* * * * *